United States Patent [19]

Martin

[11] 4,444,629

[45] Apr. 24, 1984

[54] ZINC-IRON ALLOY ELECTROPLATING BATHS AND PROCESS

[75] Inventor: Sylvia Martin, Utica, Mich.

[73] Assignee: OMI International Corporation, Warren, Mich.

[21] Appl. No.: 520,082

[22] Filed: Aug. 5, 1983

Related U.S. Application Data

[63] Continuation-in-part of Ser. No. 381,089, May 24, 1982, Pat. No. 4,401,526, and Ser. No. 381,090, May 24, 1982, Pat. No. 4,397,718.

[51] Int. Cl.[3] ..... C25D 3/56

[52] U.S. Cl. ..... 204/43 Z; 204/43 T

[58] Field of Search ..... 204/43 Z, 43 T, 123

[56] References Cited

U.S. PATENT DOCUMENTS 4,397,718 8/1983 Martin ..... 204/55 Y 4,401,526 8/1983 Martin ..... 204/43 Z

*Primary Examiner*—G. L. Kaplan

*Attorney, Agent, or Firm*—Richard P. Mueller

[57] ABSTRACT

A zinc/iron alloy electroplating bath comprising a conductive aqueous solution containing zinc ions, iron ions, and a brightening additive which is a derivative of B-aminopropionic acid or a polymer thereof. A semi-bright to bright zinc/iron alloy deposit can be electrodeposited from the bath onto a substrate.

15 Claims, No Drawings

ZINC-IRON ALLOY ELECTROPLATING BATHS AND PROCESS

This is a continuation-in-part of copending application Ser. Nos. 381,089, now U.S. Pat. No. 4,401,526, and 381,090, now U.S. Pat. No. 4,397,718, which were both filed on May 24, 1982.

The present invention relates to zinc/iron alloy electroplating baths and the process for electroplating a zinc/iron alloy onto a conductive substrate using such baths. More particularly, the present invention relates to improved compositions and processes for the electrodeposition of zinc/iron alloys from electroplating baths comprising a water-soluble derivative of $\beta$-aminopropionic acid.

BACKGROUND OF THE INVENTION

Electrodeposited zinc/iron alloys of a semi-bright to lustrous appearance are desirable to provide a decorative plating appearance while simultaneously imparting excellent corrosion protection. Generally speaking, zinc/iron alloys can be deposited on a conductive substrate by means of a zinc/iron alloy electroplating bath. Such electroplating baths and the processes using them are employed to provide alloy deposits on a variety of substrates and are often used in conjunction with ferrous substrates, such as iron or steel.

The zinc/iron alloy plating baths and process of the present invention involve the use of a brightening additive which can be used in a wide variety of types of plating baths over broad pH and current density ranges to provide a semi-bright to bright zinc/iron alloy deposit. The plating baths of the present invention are commercially useful and are characterized, in part, by their flexibility and versatility in use to obtain excellent zinc/iron alloy plating results.

A further understanding of the present invention will be obtained from the following description and examples thereof. Unless otherwise indicated, in the following description and examples, all parts are percents by weight and all temperatures are in degrees Farenheit.

SUMMARY OF THE INVENTION

In accordance with the present invention, a zinc/iron alloy electroplating bath comprises a conductive aqueous solution containing zinc ions, iron ions, and a brightening amount of a soluble brightening additive selected from the group consisting of a monomer of the following general formula and polymers thereof:

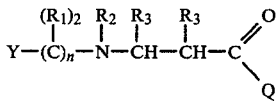

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms or

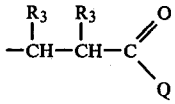

$R_3$ is H or an alkyl group having from 1 to about 4 carbon atoms, phenyl, substituted-phenyl, or

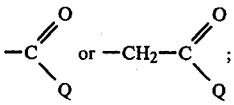

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

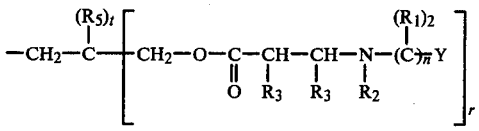

$R_5$ is H, —OH, or a hydroxyalkyl group having from 1 to about 4 carbon atoms;

r is 1 to about 3;

t is 0 to 2, r+t is an integer equal to 3 and mixtures thereof.

In accordance with the process of the present invention, a zinc/iron alloy deposit is electroplated from the aforesaid electroplating bath.

DETAILED DESCRIPTION OF THE INVENTION

The present invention pertains to zinc/iron alloy electroplating baths comprising an organic brightening agent as set forth herein and to processes employing zinc/iron electroplating baths comprising such additives for electroplating zinc/iron alloy deposits therefrom. The organic brightening additive of the present invention is a derivative of $\beta$-aminopropionic acid or a polymer thereof. In general, the organic additive used in this invention has a long working life and is effective over a wide current density range. Furthermore, the additive is stable to relatively high temperatures, even though the additive is an organic compound. Accordingly, a zinc/iron alloy electroplating bath of this invention is useful over a wide range of current densities, pH and temperatures and has a long working life.

Other than the use of the aforementioned brightening agent, zinc/iron alloy baths of the present invention will comprise any of the ingredients necessarily employed in zinc/iron alloy electroplating baths. These electroplating baths will contain iron ions and zinc ions to provide the desired zinc/iron alloy deposit or plate upon electrodeposition.

Iron ions, in accordance with conventional practice, can be introduced into the aqueous solution in the form of a soluble iron salt, such as iron sulfate, iron chloride, iron fluoroborate, iron sulfamate, iron acetate, or mixtures thereof, to provide an operating iron ion concentration ranging from about 5 grams per liter to about 140 grams per liter, with concentrations of from about 40 grams per liter to about 100 grams per liter being preferred. The zinc ions, also in accordance with conventional practice, can be introduced into the aqueous solution in the form of soluble salts of zinc, such as the chloride, sulfate, fluoroborate, acetate, or sulfamate salts, or mixtures thereof. To produce an alloy deposit containing from about 5% to about 96% of zinc, the zinc ions should be employed in the bath in an amount of from about 2 grams per liter to about 120 grams per liter. Preferably, the alloy deposits produced contain from about 10% to about 88% of zinc and the bath, to produce such alloy deposits, will contain zinc ions in an amount of from about 7 grams per liter to about 75 grams per liter.

The zinc/iron alloy electroplating bath of the present invention may also contain various other additives or agents. In some instances, a particular additive or agent may be useful for more than one purpose. Examples of such additional ingredients which may be employed in the present zinc/iron alloy electroplating baths are buffers and bath modifiers, such as boric acid, acetic acid, ammonium sulfate, sodium acetate, ammonium chloride and the like. The present zinc/iron alloy electroplating baths may also contain conductive salts, such as ammonium sulfate, ammonium chloride or bromide, ammonium fluoroborate, magnesium sulfate, sodium sulfate, and the like, to improve the conductivity of the bath.

The zinc/iron alloy electroplating bath can range in pH from about 0 up to about 6.5, preferably from about 0.5 to about 5. When the bath is weakly acidic or near neutral, such as at a pH of about 3 to about 6.5, it is preferred to incorporate conventional complexing or chelating agents to maintain an effective amount of the metal ions in solution. The preferred chelating or complexing agents are citric acid, gluconic acid, glucoheptanoic acid, tartaric acid, ascorbic acid, isoascorbic acid, malic acid, glutaric acid, muconic acid, glutamic acid, glycollic acid, aspartic acid, and the like as well as their alkali metal, ammonium, zinc or ferrous salts thereof. Additionally, suitable complexing or chelating agents that can be employed include nitrilo triacetic acid, ethylene diamine tetra ethanol, and ethylene diamine tetra acetic acid and salts thereof.

The presence of excessive amounts of ferric ions in the electroplating bath is objectionable due to the formation of striations in the plated surface. For this reason, it is desirable to control the ferric ion concentration at a level usually less than about 2 g/l. Although the iron constituent of the bath is normally introduced as ferrous ions, some oxidation of the ferrous ions to the ferric state occurs during the operation of the bath. It has been found that a control of the ferric ion formation to within acceptable levels is achieved by employing a soluble zinc anode in the electroplating bath or, alternatively, by immersing metallic zinc in the holding tank through which the electroplating solution is circulated. In the event no soluble anodes are employed in the electroplating process or no zinc metal is provided in the holding tank, appropriate control of the ferric ion concentration can be achieved employing suitable bath soluble and compatible organic and/or inorganic reducing agents such as, for example, bisulfite, isoascorbic acid, monosaccharides and disaccharides such as glucose and lactose.

The bath can also optionally contain appropriate concentrations of nickel ions or cobalt ions to provide a ternary alloy of zinc-iron and nickel or zinc-iron-cobalt. The cobalt and nickel ions can be introduced as any bath soluble salt or compound and their concentration is preferably controlled so as to provide an alloy containing from about 1 percent to about 20 percent of iron with either about 0.1 to about 2 percent cobalt or about 0.1 to about 20 percent by weight nickel and the balance essentially zinc.

In addition to the above components, the electroplating bath of the present invention includes a brightening amount of an organic brightening agent selected from the group consisting of a compound of the following general formula and polymers thereof:

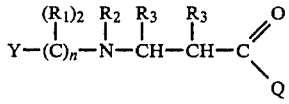

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms or

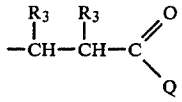

$R_3$ is H or an alkyl group having from 1 to about 4 carbon atoms, phenyl, substituted-phenyl, or

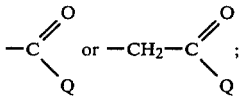

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

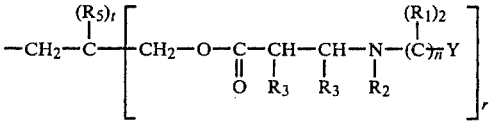

$R_5$ is H, —OH, or a hydroxyalkyl group having from 1 to about 4 carbon atoms;

r is 1 to about 3;
t is 0 to 2;
t+r is an integer equal to 3;
and mixtures thereof.

Both monomers and polymers of compounds of the above general formula are useful as brightening additives in baths and processes of this invention but polymers are preferred. Where polymers are employed herein, the exact molecular weight of the polymer or degree of polymerization is not believed to be critical. The brightening agent must, however, be water soluble, which sets a functional upper limit of molecular weight or degree of polymerization. Generally speaking, therefore, the molecular weight of the brightening additive of the present invention can vary from the molecular weight of the monomer to a molecular weight at which the polymer becomes water insoluble.

Brightening additives of the present invention can be made by the Michael Reaction, for example, by reacting a conjugated carbonyl compound, preferably carboxylic derivative such as an acrylic derivative, with a 1° or 2° amine (or its derivatives) without a basic catalyst and preferably in a polar solvent in an exothermic reaction. The polymer can then be made by heating for polymerization, after which unwanted by-products can be removed by an appropriate means such as by distillation. The polymer product is a cross-linked polymer which generally is a thick jelly, soluble in water.

Organic compounds of the above general formula and methods for making them are disclosed in Ogata et al., "The Reaction of Amino Alcohols With Acrylates,"*Bulletin of the Chemical Society of Japan,* Vol. 39, 1486–1490 (1966); Sanui et al., "The Catalytic Effect of Alcohol and Mercaptan of the Michael Reaction of Acrylates,"*Bulletin of the Chemical Society of Japan,* Vol. 40, 1727 (1967); Ogata et al., "A novel Synthesis of Polyamide from Amino Alcohol and Acrylate,"*Polymer Letters,* Vol. 4, 273–276 (1966); and Ogata et al., "Room-Temperature Polycondensation of B-Amino Acid Derivatives VI. Synthesis of Various N-(Hydroxyethyl) Nylons*, "*Journal of Polymer Science: Part A*-1, Vol. 7, 2817–2858 (1969).

Specific brightening additives of the present invention which are preferred for use herein include:

Poly[N-(2-hydroxyethyl) nitrilo di-(ethylpropionate)];
Poly[N-(2-hydroxyethyl) nitrilo di-(N'-2-hydroxyethyl) propionamide];
Poly[N-(2-hydroxyethyl)-N-(2-cyanoethyl)-β-amino propionic acid];
Tetra[N-methyl N-cyanomethyl β-amino propionate) pentaerythritol];
Poly[N-(hydroxy tert-butyl)β-amino β-methylcarboxy methyl propionate];
Poly[N-(2-hydroxypropyl)β-amino-a-methyl aceto methyl propionate];
Poly[N-(2-hydroxyethyl)B-amino-β-phenyl methyl propionate];
Poly[β-tauryl ethyl propionate];
Poly[N,N-di(2-hydroxyethyl)nitrilo β-methyl propionamide];
Poly[N-(3-hydroxypropyl)β-aminopropionamide-(N'-isopropylsodium sulfonate];
Poly[N-(2-mercaptoethyl) nitrilo di(methyl propionate];
Poly[N-(2-carboxyethyl)β-amino di(butyl propionate)];
Poly[N-(hydroxyethyl aminoethyl)β-amino(2-methoxyethyl) propionate];
Poly[N-(2-hydroxyethyl) nitrilo di-(2-ethyl hexyl propionate)];
N-(2-hydroxypropyl) nitrilo di-(polyethoxy propionate) where the molecular weight of the polyether group is about 4000;
Tetra[N-(2 hydroxyethyl)β-amino propionate]pentaerythritol and mixtures thereof.

The concentration of brightening additive employed in a plating bath of this invention can vary over a broad range. The maximum amount of the brightening additive in the bath depends upon the specific additive and may be up to the limit of its solubility in the aqueous acidic plating bath. The minimum amount of brightening additive in the bath depends upon the specific additive and factors such as the current density of the plating process. Generally speaking, the brightening additive must be employed in sufficient concentration effective to obtain the brightening effect desired. For most common purposes, the brightening additive of the present invention will be present in the bath in an amount of from 0.01 to 2.0 g/l. However, at very low current density rates, the additive can be effective in very small amounts, for example at 0.1 mg/l and at very high rates at concentrations as high as 10 g/l.

In accordance with the method of the present invention, a zinc/iron alloy deposit is electrodeposited from an electroplating bath comprising the above-described brightening additive in an amount effective to obtain the desired zinc/iron alloy deposit. The zinc/iron alloy electrodeposits of the present invention are useful for industrial purposes, such as strip plating, conduit plating, wire plating, rod plating, tube or coupling plating, electroforming to build up worn parts, plating of soldering iron tips, plating of Intaglio plates for printing, and the like. Each application will require a specific form of the electrolyte bath to be used, depending on the corrosion protection or other properties that are desired.

The zinc/iron alloy electroplating baths of the present invention can be employed over a wide range of temperatures. Typically, the temperature of operation is from about 60° F. to about 160° F., with temperatures within the range of about 65° F. to about 95° F. being preferred.

The electrodeposition of the zinc/iron alloy from the bath can be carried out using the conventional methods or the newer, high speed functional methods. These baths may be used over a wide range of operating conditions since the brightening additives of the present invention will enhance the deposit of a semi-bright to a bright zinc/iron alloy deposit, over a wide range of pH, temperature and current density conditions. Additionally, the brightening agents utilized have a long working life so that the baths of this invention are very economical to operate.

Typically, the zinc/iron alloy deposit will be electrodeposited from the baths of the present invention using an average cathode current density of from about 10 to about 5,000 amps per square foot (ASF), when the bath temperatures are within the range of about 65° F. to about 160° F. The maximum cathode current density which may be used will depend upon the particular type of deposit desired and the electrolyte employed. The electroplating baths may be agitated with air or agitated mechanically during plating or the work pieces may themselves be mechanically moved such as desired. Due to the possible formation of ferric iron in the baths, mechanical agitation is often preferred. Alternatively, however, the plating solution may be pumped to create turbulence as it flows past the work piece. Additionally, in many instances it has been found to be preferable to utilize soluble anodes in the process, rather than insoluble anodes.

The following examples are set forth to further illustrate the present invention and the manner in which it may be practiced.

EXAMPLE 1

An aqueous acid iron-zinc alloy plating bath was formulated containing the following ingredients:

| | Amount |
|---|---|
| ferrous sulfate heptahydrate | 530 g/l |
| zinc sulfate monohydrate | 34 g/l |
| poly[N—(2-hydroxyethyl) nitrilo di-(ethyl propionate)] | 50 mg/l |
| pH | 1.6 |

The cathode was agitated by mechanical rotation at 3600 RPM at 120° F. using a current density of 950 ASF. A bright 32% zinc alloy was deposited on the cathode.

EXAMPLE 2

An aqueous acid iron/zinc alloy plating bath was formulated containing the following ingredients

| | Amount |
|---|---|
| ferrous sulfate heptahydrate | 388 g/l |
| zinc sulfate monohydrate | 132 g/l |
| poly [N—(2-hydroxyethyl) nitrilo di-(2-ethylhexyl propionate)] | 0.16 g/l |
| pH | 0.5 |

The bath was used for plating steel strip traveling at a speed of 400 ft/minute. The cathode current density was 1000 ASF and the temperature was 126° F. The alloy plate deposited was bright with an alloy concentration of 90% zinc.

EXAMPLE 3

An aqueous acid iron/zinc alloy plating bath was formulated containing the following ingredients:

| | Amount |
|---|---|
| ferrous sulfate heptahydrate | 518 g/l |
| zinc sulfate monohydrate | 32 g/l |
| magnesium sulfate heptahydrate | 70 g/l |
| sodium sulfate | 125 g/l |
| poly[N—(2 hydroxyethyl) nitrilo di-propionamide] | 100 mg/l |
| pH | 2.1 |

A steel conduit was plated with mechanical cathode movement at 100 ASF at 125° F. The alloy plate was bright and produced a 66% zinc alloy. The alloy deposit was excellent for painting the conduit afterwards.

EXAMPLE 4

An aqueous acid iron/zinc alloy plating bath was formulated containing the following ingredients:

-continued

| | Amount |
|---|---|
| ferrous chloride tetrahydrate | 60 g/l |
| zinc chloride | 40 g/l |
| sodium chloride | 180 g/l |
| ammonium chloride | 70 g/l |
| boric acid | 40 g/l |
| isoascorbic acid | 30 g/l |
| pH | 1.5 |
| poly[N—(2-hydroxyethyl) nitrilo di-(methyl propionate)] | 0.50 g/l |
| N(2-hydroxy propyl) nitrilo di(polyethoxy propionate) | 0.25 g/l |

A mechanically agitated Hull Cell panel was plated at 3 amperes for 5 minutes with the temperature at 120° F. The deposit was bright all the way across the panel. The current density will vary across the Hull Cell panel.

EXAMPLE 5

| | Amount |
|---|---|
| zinc sulfate monohydrate | 100 g/l |
| cobalt sulfate hexahydrate | 50 g/l |
| ferrous sulfate heptahydrate | 100 g/l |
| poly[N—(2-hydroxyethyl) nitrilo-di-N'(ethylpropionate)] | 0.75 g/l |

The bath is pH=2 using zinc anodes with temperature at 120° F. A bright zinc alloy is deposited at 1000 ASF with 300 ft/min strip movement. The alloy contains 4% iron and 0.75% cobalt.

While the above disclosure sets forth and describes various embodiments of the present invention, the compositions and methods described are intended to illustrate but not limit the present invention. It will be understood that the specific embodiments described herein are subject to variation and modification by one skilled in the art having benefit of the present disclosure. Therefore, it is intended that the present invention is to be limited solely by the following claims.

What is claimed is:

1. An aqueous zinc/iron alloy electroplating bath having a pH of from about 0 up to about 6.5 and comprising a conductive aqueous solution containing zinc ions, iron ions, and a brightening amount of a brightening additive selected from the group consisting of a monomer of the following general formula and polymers thereof:

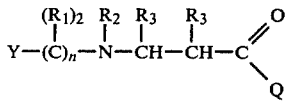

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms or

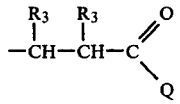

$R_3$ is H or an alkyl group having from 1 to about 4 carbon atoms, phenyl, substituted-phenyl, or

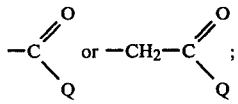

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

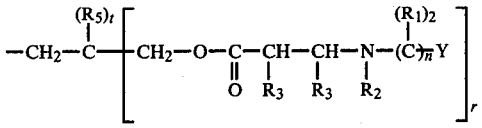

$R_5$ is H, —OH, or a hydroxyalkyl group having from 1 to about 4 carbon atoms;

r is 1 to about 3;

t is 0 to 2;

t+r is an integer equal to 3;

and mixtures thereof.

2. The bath of claim 1 wherein said brightening additive is selected from the group consisting of:

Poly[N-(2-hydroxyethyl)nitrilo di-(ethylpropionate)];

Poly[N-(2-hydroxyethyl)nitrilo di-(N'-2-hydroxyethyl)-propionamide];

Poly[N-(2-hydroxyethyl)-N-(2-cyanoethyl)-β-amino propionic acid];

Tetra[N-methyl N-cyanomethyl β-amino propionate]-pentaerythritol;

Poly[N-(hydroxy tert-butyl)β-amino β-methylcarboxy methyl propionate];

Poly[N-(2-hydroxypropyl)β-amino-a-methyl aceto methyl propionate];

Poly[N-(2-hydroxyethyl)β-amino-β-phenyl methyl propionate];

Poly[B-tauryl ethyl propionate];

Poly[N,N-di(2-hydroxyethyl)nitrilo β-methyl propionamide];

Poly[N-(3-hydroxypropyl)B-aminopropionamide-(N'-isopropylsodium sulfonate];

Poly[N-(2-mercaptoethyl)nitrilo di(methyl propionate)];

Poly[N-(2-carboxyethyl)β-amino di(butyl propionate)];

Poly[N-(hydroxyethyl aminoethyl)β-amino(2-methoxyethyl)propionate];

Poly[N-(2-hydroxyethyl)nitrilo di-(2-ethyl hexyl propionate)];

N-(2-hydroxypropyl)nitrilo di-(polyethoxy propionate) where the molecular weight of the polyether group is about 4000;

Tetra[N-(2 hydroxyethyl)B-amino propionate]pentaerythritol; and mixtures thereof.

3. The bath of claim 2 wherein said brightening additive is present in an amount of from about 0.010 g/l to about 2 g/l.

4. The bath of claim 2 wherein said bath has a pH of from about 3.0 to about 6.5 and contains chelating agents to keep the metal ions in solution.

5. The bath of claim 1 wherein said brightening additive is present in an amount of from about 0.1 mg/l to about 10 g/l.

6. The bath of claim 1 wherein an additional alloying material is present selected from nickel and cobalt ions in concentrations sufficient to produce a ternary alloy containing 0.1 to 20% nickel or 0.1 to 2% cobalt.

7. A process for electroplating a zinc/iron alloy deposit onto a substrate comprising electrodepositing said alloy from a conductive aqueous solution containing zinc ions, iron ions, and a brightening amount of a water-soluble brightening additive selected from the group consisting of a monomer of the following general formula and polymers thereof:

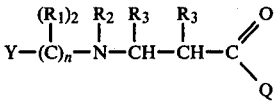

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms or

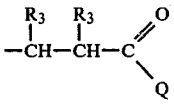

$R_3$ is H or an alkyl group having from 1 to about 4 carbon atoms, phenyl, substituted-phenyl, or

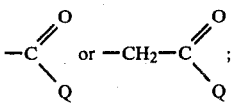

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

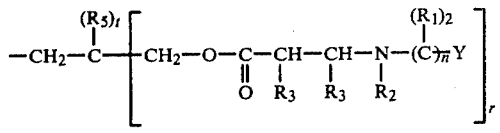

$R_5$ is H, —OH, or a hydroxyalkyl group having from 1 to about 4 carbon atoms;

r is 1 to about 3;

t is 0 to 2;

t+r is an integer equal to 3;

and mixtures thereof.

8. The process of claim 7 wherein said brightening additive is selected from the group consisting of:

Poly[N-(2-hydroxyethyl)nitrilo di-(ethylpropionate)];

Poly[N-(2-hydroxyethyl)nitrilo di-(N'-2-hydroxyethyl)-propionamide];

Poly[N-(2-hydroxyethyl)-N-(2-cyanoethyl)-β-amino propionic acid];

Tetra[N-methyl N-cyanomethyl β-amino propionate]-pentaerythritol;

Poly[N-(hydroxy tert-butyl)β-amino β-methylcarboxy methyl propionate];

Poly[N-(2-hydroxypropyl)β-amino-a-methyl aceto methyl propionate];

Poly[N-(2-hydroxyethyl)β-amino-β-phenyl methyl propionate];

Poly[B-tauryl ethyl propionate];

Poly[N,N-di(2-hydroxyethyl)nitrilo β-methyl propionamide];

Poly[N-(3-hydroxypropyl)β-aminopropionamide-(N'-isopropyl sodium sulfonate];

Poly[N-(2-mercaptoethyl)nitrilo di(methyl propionate)];

Poly[N-(2-carboxyethyl)β-amino di(butyl propionate)];

Poly[N-(hydroxyethyl aminoethyl)β-amino(2-methoxyethyl)propionate];

Poly[N-(2-hydroxyethyl)nitrilo di-(2-ethyl hexyl propionate)];

N-(2-hydroxypropyl)nitrilo di-(polyethoxy propionate) where the molecular weight of the polyether group is about 4000;

Tetra[N-(2 hydroxyethyl)β-amino propionate]pentaerythritol;

and mixtures thereof.

9. The process of claim 8 wherein said brightening additive is present in an amount of from about 0.01 g/l about 2 g/l.

10. The process of claim 8 wherein said bath has a pH of about 3.0 to about 6.5 and contains a chelating agent in an amount effective to keep metal ions in solution.

11. The process of claim 8 wherein the electrodeposition is carried out at a current density of from about 10 to about 5000 ASF.

12. The process of claim 7 wherein said brightening additive is present in an amount from about 0.1 mg/l to about 10 g/l.

13. The process of claim 7 wherein said brightening additive is present in an amount of from about 0.01 g/l to about 2 g/l.

14. The process of claim 7 wherein the electrodeposition is carried out at a current density of from about 10 to about 5000 ASF.

15. The process of claim 7 wherein the bath contains an additional alloying material selected from nickel and cobalt ions in concentrations sufficient to produce a ternary alloy containing 0.1 to 20% nickel or 0.1 to 2% cobalt.

* * * * *